US008252411B2

(12) United States Patent
Veronesi et al.

(10) Patent No.: US 8,252,411 B2
(45) Date of Patent: Aug. 28, 2012

(54) JOINT CONFIGURATION FOR A LOAD BEARING ASSEMBLY

(75) Inventors: William A. Veronesi, Hartford, CT (US); Justin R. Hawkes, Vernon, CT (US); John M. Milton-Benoit, West Suffield, CT (US); John P. Wesson, Vernon, CT (US); Tahany I. El-Wardany, West Hartford, CT (US); Changsheng Guo, South Windsor, CT (US); Wenlong Li, Tolland, CT (US)

(73) Assignee: Otis Elevator Company, Farmington, CT (US)

( * ) Notice: Subject to any disclaimer, the term of this patent is extended or adjusted under 35 U.S.C. 154(b) by 1204 days.

(21) Appl. No.: 11/577,994

(22) PCT Filed: Nov. 24, 2004

(86) PCT No.: PCT/US2004/039669

§ 371 (c)(1),
(2), (4) Date: Apr. 26, 2007

(87) PCT Pub. No.: WO2006/057641

PCT Pub. Date: Jun. 1, 2006

(65) Prior Publication Data

US 2009/0126296 A1 May 21, 2009

(51) Int. Cl.
*D04H 1/00* (2006.01)
*B66C 1/12* (2006.01)

(52) U.S. Cl. ..... 428/292.1; 428/375; 428/378; 294/74

(58) Field of Classification Search ..... None
See application file for complete search history.

(56) References Cited

U.S. PATENT DOCUMENTS

| | | | | | |
|---|---|---|---|---|---|
| 1,429,638 | A | * | 9/1922 | Rutz | 474/247 |
| 1,612,024 | A | * | 12/1926 | Jacobs | 474/262 |
| 2,559,783 | A | * | 7/1951 | Moon | 160/130 |
| 2,955,065 | A | * | 10/1960 | Victor | 156/98 |
| 3,134,843 | A | * | 5/1964 | Monelli | 174/88 R |
| 3,234,611 | A | | 2/1966 | Paasche | |
| 3,466,080 | A | * | 9/1969 | Norton | 294/74 |

(Continued)

FOREIGN PATENT DOCUMENTS

DE 3303773 A1 8/1984

(Continued)

OTHER PUBLICATIONS

PCT International Search Report and Written Opinion of the International Searching Authority mailed Apr. 5, 2006.

(Continued)

*Primary Examiner* — Jill Gray
(74) *Attorney, Agent, or Firm* — Carlson, Gaskey & Olds PC

(57) ABSTRACT

A load bearing assembly (20) includes a plurality of tension members (22). A joint in the load bearing assembly (20) has a staggered pattern of discontinuities (30) in the tension members (22). A stress relieving feature is associated with at least outermost tension members (22A, 22L) in the vicinity of the discontinuities. One example includes supplemental tension members (32, 50) as the stress relieving feature. Another example includes selected spacings (32', 40, 42) between ends of at least some of the tension members. One example includes different sized tension members as the stress relieving feature. Another example includes different lateral spacings between selected tension members.

18 Claims, 2 Drawing Sheets

U.S. PATENT DOCUMENTS

| | | | | | |
|---|---|---|---|---|---|
| 3,481,807 | A | * | 12/1969 | Hisao | 156/159 |
| 3,498,038 | A | * | 3/1970 | Shulver | 57/7 |
| 3,724,645 | A | * | 4/1973 | Spaar | 198/847 |
| 3,919,762 | A | * | 11/1975 | Borelly | 29/447 |
| 4,117,582 | A | * | 10/1978 | Borelly | 29/419.1 |
| 4,648,856 | A | * | 3/1987 | Matsunaga | 474/237 |
| 5,181,601 | A | * | 1/1993 | Palmaer et al. | 198/831 |
| 5,238,279 | A | * | 8/1993 | Anteau | 294/74 |
| 5,310,046 | A | * | 5/1994 | Palmaer et al. | 198/831 |
| 5,419,428 | A | * | 5/1995 | Palmaer et al. | 198/831 |
| 5,567,535 | A | * | 10/1996 | Pettit | 428/608 |
| 5,645,160 | A | * | 7/1997 | Palmaer et al. | 198/853 |
| 6,295,799 | B1 | | 10/2001 | Baranda | |
| 7,438,778 | B2 | * | 10/2008 | Tsuru | 156/159 |
| 7,553,108 | B2 | * | 6/2009 | Langwadt et al. | 405/259.1 |
| 2003/0010966 | A1 | | 1/2003 | Sjostedt | |
| 2010/0078296 | A1 | * | 4/2010 | Lapeyre et al. | 198/844.2 |

FOREIGN PATENT DOCUMENTS

| | | | |
|---|---|---|---|
| JP | 5540239 | | 9/1953 |
| JP | 60065936 | A | 4/1985 |
| JP | 11173384 | | 6/1999 |

OTHER PUBLICATIONS

PCT International Preliminary Report on Patentability for International application No. PCT/US2004/039669 filed Nov. 24, 2004.

Supplementary European Search Report for Application No. EP 04 81 2232 mail Jan. 13, 2011.

* cited by examiner

JOINT CONFIGURATION FOR A LOAD BEARING ASSEMBLY

1. FIELD OF THE INVENTION

This invention generally relates to load bearing assemblies that could be used in an elevator system or a passenger conveyor system, for example. More particularly, this invention relates to joint configurations for such load bearing assemblies.

2. DESCRIPTION OF THE RELATED ART

Various load bearing assemblies are known and used for a variety of purposes. In elevator systems, for example, one type of load bearing assembly comprises a steel rope. More recently, coated belts having a polymer jacket generally surrounding a plurality of tension members have been introduced. In some examples, the tension members comprise steel cords. In other examples, the tension members comprise polymer materials.

Although continuous tension members are used in most elevator systems, it may be useful to join ends of a linear assembly to form a loop. Providing a closed loop load bearing assembly of the type used in an elevator system may provide significant advantages for testing the properties of such a load bearing assembly.

The bending fatigue properties of such load bearing assemblies, such as the number of bend cycles the assembly can undergo prior to failure, are difficult to measure at conditions typical of service in an elevator system. Millions of bend cycles are required for many testing situations. Reciprocating bending fatigue testers are typically used to cycle such load bearing assemblies through a series of bends quickly to determine the maximum bending life of the assembly. There are difficulties in designing a reciprocating machine without significant reciprocating mass. Known machines tend to be limited in speed and ability to provide consistent fatigue conditions over significant lengths of such a load bearing assembly.

If it is possible to provide a continuous loop, then testing can be simplified. For example, a steady, non-reciprocating test rig may be used to more quickly accumulate bend cycles or to generate steady conditions of dynamic traction.

Another application of load bearing assemblies having tension members is a passenger conveyor handrail. These typically require at least one joint because the load bearing assembly typically is made as a linear assembly and then two ends are joined together to form a loop.

A variety of techniques for providing joints in such load bearing assemblies are known. One example technique is to use an overlapping joint where ends of the tension members are overlapped and the jacket material is secured together. A difficulty with such lap joints is that it greatly increases the stiffness of the assembly in the area of the joint. The increased stiffness introduces additional bending fatigue, which can be disadvantageous where flexibility and long service life are desired. Further, such lap joints do not have sufficient strength to meet the needs of some situations.

Another proposed arrangement is to have the tension members cut in a fashion so that they appear as interlocking fingers. The ends of the individual tension members are generally aligned across the joint. While such arrangements do not have the additional stiffness drawback of an overlapped joint, they suffer from the drawback of having a decreased strength on the order of fifty percent of the strength of the tension members across an area that does not include a joint. Therefore, such joints are not useful for many applications.

There is a need for an improved arrangements for joining ends of a load bearing assembly having a plurality of tension members. This invention addresses that need by providing various configurations to improve joint strength and maintain the flexibility characteristics desired for such a load bearing assembly.

SUMMARY OF THE INVENTION

An example load bearing assembly includes a plurality of tension members. Each tension member has a discontinuity. The discontinuities are staggered in a lengthwise direction (i.e., relative to the length of the tension members) such that the discontinuities in adjacent ones of the tension members are at different lengthwise positions. A stress relieving feature is included near at least the discontinuity of each of the outermost tension members.

One example includes supplemental tension members as the stress relieving feature. In one example, supplemental tension members are secured to an exterior of a jacket that generally surrounds the tension members.

In another example, the stress relieving feature comprises lengthwise gaps between ends of the outermost tension members. One such example includes another gap between the ends of at least one centrally located tension member. In one disclosed example, the ends of every tension member are spaced by a gap.

In another example, a supplemental tension member is associated with each of the tension member discontinuities. In one example, the supplemental tension members comprise a different material than the tension members. In one example, the tension members comprise steel cords and the supplemental tension members comprise a synthetic material. One example includes synthetic rods or cords.

Another example includes different lateral spacings between the outermost tension members and the next adjacent tension members.

Another example includes the tension members adjacent the outermost tension members having a larger physical size than the remainder of the tension members.

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
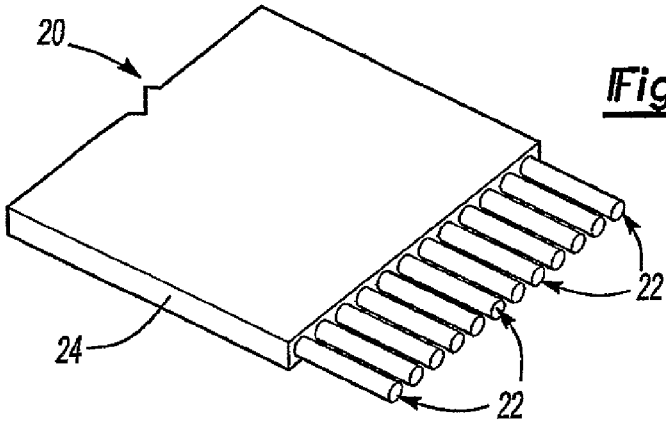
FIG. 1 diagrammatically illustrates a selected portion of a load bearing assembly having a plurality of tension members generally surrounded by a jacket.

FIG. 1 diagrammatically shows a selected portion of a load bearing assembly 20. A plurality of tension members 22 are generally surrounded by a polymer jacket 24. In one example, the tension members 22 comprise steel cords. In another example, the tension members 22 comprise polymer materials. An example jacket 24 comprises a polymer material such as a thermoplastic polyurethane.

One example use for such a load bearing assembly is for supporting an elevator car and counterweight within an elevator system. Another example use of such a load bearing assembly is a handrail for a passenger conveyor such as an escalator. In the latter case, it is necessary to join two ends of a generally straight assembly to form a loop. In the case of a load bearing assembly for an elevator system, it may be advantageous to establish a loop for testing purposes, for example.

Using a joint design as disclosed in this description allows for improved testing conditions because the joint design provides superior strength to previous arrangements. Therefore, bend fatigue life cycles can be more accurately tested in a more convenient manner when applying the principles of one or more of the disclosed examples.

Figure 2:
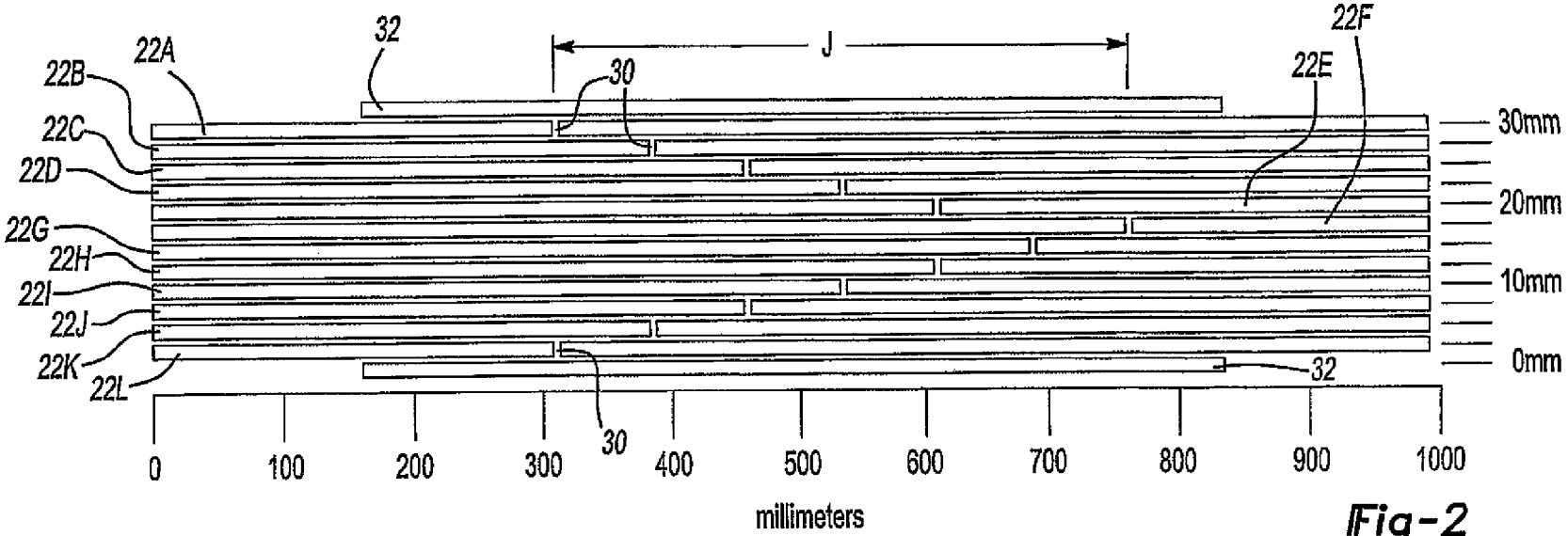
FIG. 2 schematically illustrates one example joint design.

FIG. 2 schematically illustrates one example joint design for joining two ends of a load bearing assembly having a configuration generally corresponding to that shown in FIG. 1. For discussion purposes, various sections of the load beating assembly 20 are schematically shown in FIG. 2 without detailing spacing between tension members that would be occupied by the material of the jacket 24. As can be appreciated from the illustration, discontinuities 30 in each tension member 22 are staggered in a pattern so that adjacent discontinuities are at different lengthwise (i.e., longitudinal) positions. The discontinuities 30 in this example correspond to cut ends of the tension members adjacent each other but not joined together. In this example, the ends of the tension members are not welded or otherwise fused or joined together. The overall joint is maintained by bonding, fusing or gluing the jacket 24 material together. Various known techniques exist for securing known jacket materials together for such purposes.

In addition to having the adjacent joints at different lengthwise positions, the example of FIG. 2 includes a stress relieving feature associated with at least the outermost tension members 22A and 22L. In this example, supplemental tension members 32 are provided on an outside of the jacket 24 adjacent the outermost tension members 22A and 22L. In this example, the supplemental tension members 32 comprise the same material as the tension members 22A-22L. The supplemental tension members 32 in this example are secured to an exterior surface of the jacket 24 using a bonding, gluing or fusing technique. That will be apparent to those skilled in the art who have the benefit of this description.

The supplemental tension members 32 in this example are arranged parallel to and in the same plane as the plurality of tension members 22A-22L. The supplemental tension members 32 effectively reduce the average load in all of the tension members in the vicinity of the discontinuities 30. The load transferred to the outermost tension members 22A or 22L, which are adjacent the supplemental tension members 32, is less than that carried by a typical tension member at a location far from the joint. This is, at least in part, because the next innermost tension members 22B or 22K can be displaced relative to the corresponding supplemental tension member 32 without significant strain in the tension member, itself. Such displacement results in larger shear strains in the polymer material of the jacket 24 between the outermost tension member 22A or 22L and the next innermost tension member 22B or 22K, respectively. Consequently, more of the load can be transferred to the tension members away from the outermost edges of the load bearing assembly. The net result is that the load increases on the tension members 22B and 22K adjacent the outermost tension members 22A and 22L by less than a factor of two over the average tension member load far from the joint.

In one example, the combination of such a staggered joint pattern and supplemental tension members results in a design that can support more than 50% of the ultimate tensile load for a load bearing assembly with no discontinuous tension members. In some examples, using a supplemental tension member 32 on each side of the load bearing assembly provides up to 75% of the ultimate tensile load for an assembly that has no discontinuous tension members.

The addition of the stress relieving feature avoids the tendency for a discontinuity in an outermost tension member to cause failure of the next adjacent tension member and then sequential feature across the assembly.

For example, the load in a tension member adjacent to another tension member discontinuity typically increases to carry nearly all of the load carried by the discontinuous tension member far from the discontinuity. This occurs because a polymer jacket typically has a modulus several orders of magnitude smaller than the tension member (i.e., a steel cord). Load is transferred from one tension member to another by shear in the polymer of the jacket material. While there is a large shear strain in the polymer near a tension member discontinuity, no significant shear can develop in the polymer on the opposite side of an adjacent, intact tension member. The intact tension members limit the shear strain developed in the polymer near the discontinuity on an opposite side of an intact tension member. Accordingly, when a tension member on an edge of a load bearing assembly having a configuration as generally shown in FIG. 1 becomes broken or cut, the next adjacent tension member will experience approximately twice the load of another tension member in an intact arrangement. That tension member will eventually fail. As successive tension members in from an edge fail, the overload is transferred to the next adjacent tension member. In some situations, such load transfer between the tension members produces a failure across the load beating assembly at about 50% of the ultimate tensile load for an assembly having no interrupted or discontinuous tension members.

Adding a stress relieving feature, such as the supplemental tension members 32 shown in FIG. 2, reduces the load increase on adjacent tension members that would otherwise result from the discontinuities 30 in the outermost tension members 22A and 22L.

In the example of FIG. 2, the joint has a length J which extends across a distance in the lengthwise direction of the load bearing assembly corresponding to positions of the furthest spaced discontinuities 30. As can be appreciated from the illustration, a length of the example supplemental tension members 32 is significantly less than the overall length of the tension members 22A-22L. In this example, the length of the supplemental tension members 32 is greater than the length J of the joint.

The example in FIG. 2 has twelve tension members and a width of the load bearing assembly is approximately 30 millimeters. An example lengthwise spacing of the discontinuities 30 for such a load bearing assembly can be appreciated by considering the scale along the lower edge of FIG. 2. In this example, the lengthwise spacing between adjacent discontinuities is typically less than 100 millimeters. The total joint length J is on the order of 40 mm.

In the example of FIG. 2, the tension members 22F and 22G are not cut at the same lengthwise position to avoid higher stress in the tension members 22E and 22H, respectively. Accordingly, the spacing between the discontinuities and the tension member 22E and 22F is greater than the spacing between other adjacent discontinuities.

Spacing the discontinuities 30 in the tension members 22 in a lengthwise direction can be varied to meet the needs of a particular situation. In one example, the spacing is selected such that the bonded polymer interface between the cuts in the tension members (i.e., the facing ends) can reliably support in shear somewhat more than the load carried by any single tension member far from the joint area carries. In one example, the spacing is selected based upon the length of material needed for surrounding one of the tension members to prevent pullout from the polymer jacket over such a length. In one example, the lengthwise spacings exceed the minimum length that prevents pullout.

Figure 3:
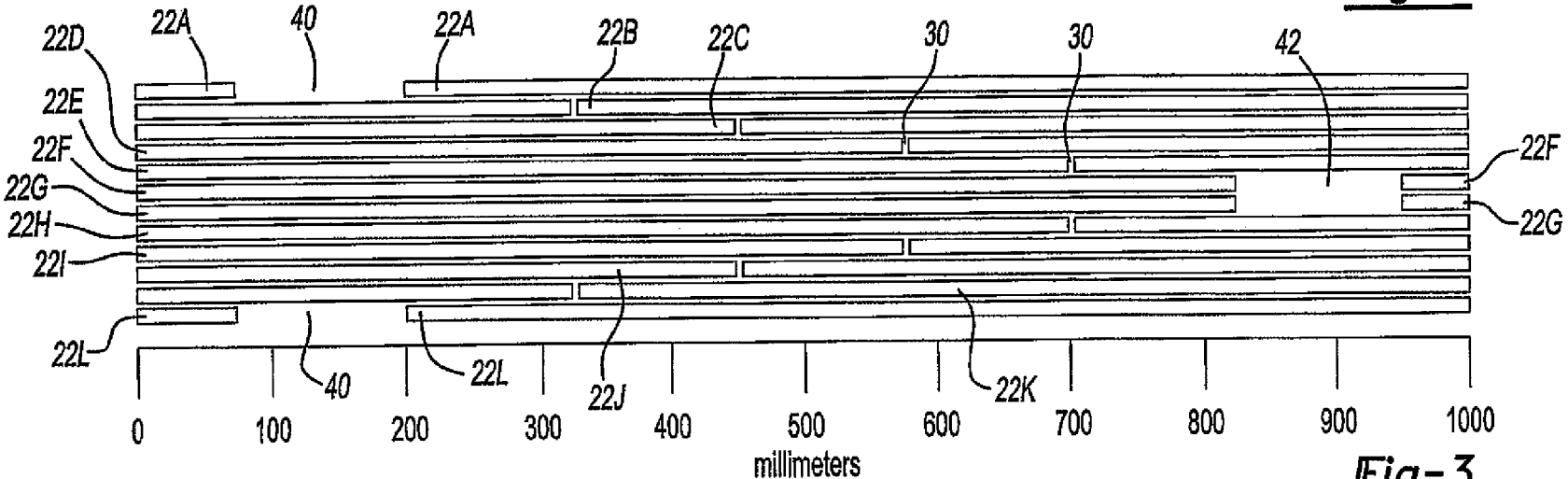
FIG. 3 schematically illustrates another example joint design.

Another example arrangement is shown in FIG. 3. This example includes a staggered joint arrangement where the discontinuities 30 for adjacent tension members are at different lengthwise positions. The stress relieving feature in this example comprises a gap 40 between the ends of the outermost tension members 22A and 22L, respectively. Another gap 42 exists between the ends of at least one centrally located tension member. In this example, the tension members 22F and 220 both have the gap 42 between their respective ends. It also can be noted that the ends of the tension members 22E and 220 are aligned at the same lengthwise position, which does not interrupt the benefits of having a staggered joint design because of the presence of the gap 42. In the example of FIG. 3, it is acceptable to have the ends of the tension members 22F and 22G at the same lengthwise position.

The gaps 40 and 42 in this example do not include any tension member material. They may be refilled with the polymer material of the jacket to preserve an exterior surface of the jacket, for example. The gaps 40 and 42 in this example do not include any reinforcing additions or other materials.

The gaps 40 and 42 avoid stress concentration in the intact portions of tension members adjacent the outermost tension members 22A and 22L so that the undesired load transfer effect described above does not occur.

In one example, utilizing gaps 40 and 42 provides a joint strength that is more than 75% of the ultimate tension load of a load bearing assembly having no discontinuities in the tension members.

It should be noted that while the staggered patterns of FIGS. 2 and 3 are very similar, other staggered patterns are possible and those skilled in the art who have the benefit of this description will be able to select an appropriate staggered pattern to meet their particular needs.

Figure 4:
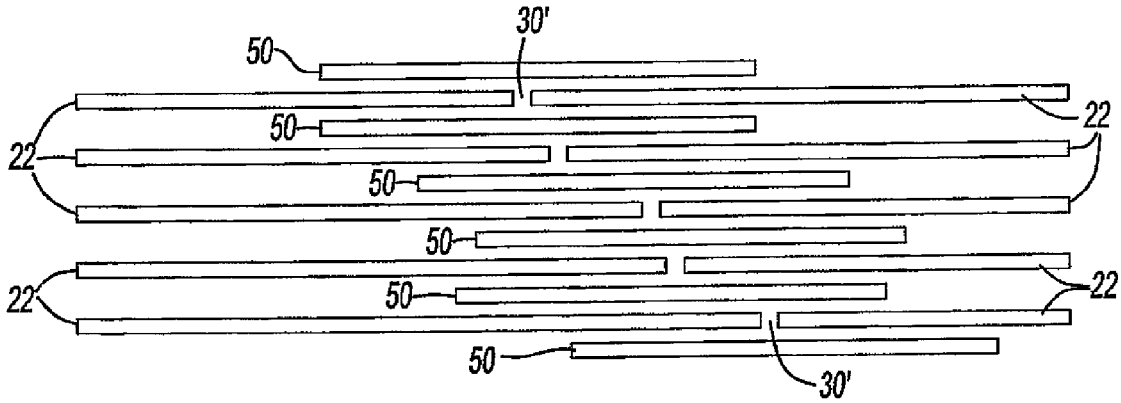
FIG. 4 schematically illustrates another example joint design.

FIG. 4 schematically illustrates another joint arrangement. In this example, a gap 30' is provided between the facing ends of every tension member 22. In one example, the lengthwise dimension of the gaps 30' is on the order of 7 to 8 times a diameter of each tension member. In one example, such an arrangement minimizes the maximum stress in the region of the joint. In the example of FIG. 4, a staggered joint pattern is used as none of the discontinuities 30' are at the same lengthwise or longitudinal location as another.

The stress relieving feature in example of FIG. 4 includes supplemental tension members 50 associated with each of the tension members 22. In this example, the supplemental tension members 50 are positioned parallel with and generally in the same plane as the tension members 22.

In one example, the supplemental tension members 50 have a length that is substantially less than the tension members 52 but greater than a distance across each gap 30' associated with the discontinuities between the ends of the tension members 22.

In one example, the supplemental tension members 50 comprises a different material than the material used for making the tension members 22. In one example, the tension members 22 comprise steel cords and the supplemental tension members comprise a synthetic material. Example synthetic materials include poly-paraphenylene terephthalamide, polyamides (nylons), polyimides, PBI, PBO, polyphenylsulfide and pre-tensilized polyolefins. Such materials are known and sold under various trade names including. KEVLAR, VECTRAN and SPECTRA.

The supplemental tension members 50 may take various forms. In one example, they comprise rods or cords. Another example includes a woven fabric or sheet of the synthetic material. Another example includes a film. Those skilled in the art who have the benefit of this description will be able to select an appropriate material and configuration to achieve a desired load sharing ratio to meet their particular needs.

In one example, the supplemental tension members 50 are supported in a mold in a desired alignment with the tension members 22, which have been at least partially removed from at least some of the jacket material to facilitate aligning the tension members as schematically shown in FIG. 4. The joint area then has additional jacket material recast over the joint area to generally surround the tension members 22 and at least partially support the supplemental tension members 50 within the jacket material. In one example, the supplemental tension members 50 become completely encased in the polymer jacket material as a result of the recasting process. In such an example, the recasting process is used to join the polymer jacket material together in known manner.

Figure 5:
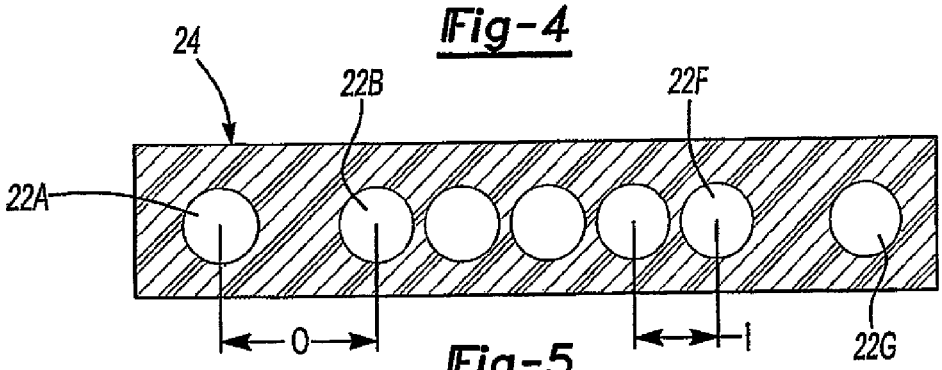
FIG. 5 schematically illustrates another example load bearing assembly configuration.

FIG. 5 shows another example arrangement having a different stress relieving feature. In this example, the stress relieving feature comprises different lateral spacings between the tension members. In this example, the outermost tension members 22A and 22G are spaced a distance O from the next outermost tension members 22B and 22F, respectively. The other tension members are spaced apart by a distance I. As can be appreciated from FIG. 5, the distance O is greater than the distance I. Including additional jacket material between the outermost tension members 22A and 22G and the next adjacent tension members reduces the stress in the next adjacent tension members 22B and 22F in the area of the discontinuities in the outermost tension members 22A and 22G.

Figure 6:
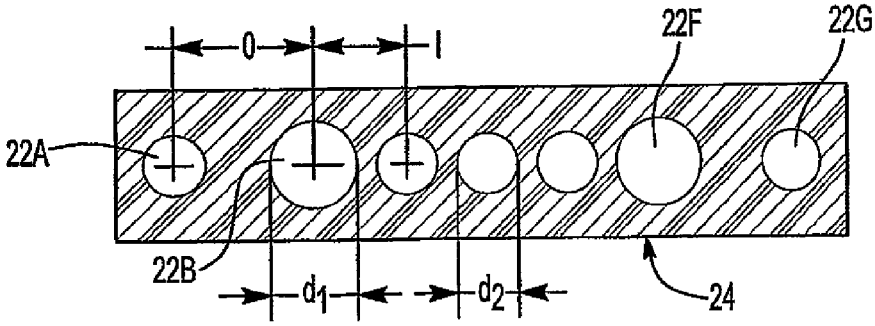
FIG. 6 schematically illustrates another example load bearing assembly configuration.

Another example arrangement is shown in FIG. 6. This example includes lateral spacing similar to that used in the example of FIG. 5. Another feature of the example of FIG. 6 is having different dimensions for selected ones of the tension members. In this example, the outermost tension members 22A and 22G and the innermost tension members have a smaller outside dimension than the tension members adjacent the outermost tension members. The tension members 22B and 22F have a first outside diameter $d_1$. The other tension members have an outside diameter $d_2$, which is less than the diameter $d_1$. Increasing the size of the tension members 22B and 22F (i.e., those adjacent the outermost tension members) provides additional strength for absorbing the loads associated with the discontinuities in the outermost tension members 22A and 22G.

It is also possible to use different tension member dimensions without the different spacings shown in FIG. 6. In other words, the example of FIG. 6 combines the feature of FIG. 5 with a feature comprising different sized tension members.

Those skilled in the art who have the benefit of this description will realize that various combinations of the disclosed stress relieving features are possible. Given this description, they will be able to select an appropriate one or more of the features to meet the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A load bearing assembly, comprising:

a plurality of elongated cord primary tension members arranged generally parallel to each other in a lengthwise direction, each primary tension member having a discontinuity, the discontinuities being staggered in the lengthwise direction such that the discontinuities in primary tension members that are adjacent to each other are at different lengthwise positions; and an elongated cord stress relieving supplemental tension member positioned on each lateral side of each discontinuity such that there is at least one supplemental tension member outside of laterally outermost primary tension members and at least one supplemental tension member between adjacent primary tension members, each supplemental tension member having a length in the lengthwise direction that is greater than a lengthwise dimension of the discontinuity that is closest to the supplemental tension member, a first portion of the length of each supplemental tension member being on a first lengthwise side of the closest discontinuity and a second portion of the length being on a second, opposite lengthwise side of the closest discontinuity.

2. The assembly of claim 1, wherein the plurality of primary tension members comprise a first material and the supplemental tension members comprise a second, different material.

3. The assembly of claim 2, wherein the supplemental tension members comprise at least one of poly-paraphenylene terephthalamide, a polyamide, a polyimide, PBI fibers, PBO fibers, polyphenylsulfide, or a pre-tensilized polyolefin.

4. The assembly of claim 1, wherein the primary tension members have a diameter and wherein the discontinuity in the outermost primary tension members has a lengthwise dimension that is at least seven times the diameter.

5. The assembly of claim 1, comprising a first lateral spacing between each of the laterally outermost primary tension members and a closest adjacent primary tension member and a second, smaller lateral spacing between adjacent ones of the others of the plurality of tension members.

6. The assembly of claim 5, wherein the primary tension members each have a diameter and comprising a first diameter for the laterally outermost primary tension members and a second, larger diameter for the primary tension members immediately laterally adjacent the outermost primary tension members.

7. The assembly of claim 1, wherein the primary tension members each have a diameter and comprising a first diameter for the outermost primary tension members and a second, larger diameter for the primary tension members immediately laterally adjacent the outermost tension members.

8. The assembly of claim 7, wherein some of the primary tension members are centrally located between the primary tension members immediately adjacent the outermost primary tension members and wherein the centrally located tension members have the first diameter.

9. The assembly of claim 1, including a polymer jacket generally surrounding the primary tension members and a lengthwise spacing between two adjacent discontinuities that provides an amount of the jacket in the lengthwise direction between the primary tension members having the two adjacent discontinuities, the amount of the jacket having a strength sufficient to support a shear load in the vicinity of the discontinuities that is greater than a load carried by any one of the primary tension members at a portion of the assembly remote from the discontinuities.

10. The assembly of claim 1, wherein each discontinuity is between oppositely facing ends of each primary tension member in the lengthwise direction and wherein the oppositely facing ends of all of the primary tension members are in a single plane.

11. The assembly of claim 1, wherein the supplemental tension members are distinct from the primary tension members.

12. The load bearing assembly of claim 1, wherein each of the tension members comprises a steel cord.

13. The load bearing assembly of claim 1, wherein each of the tension members has a circular cross-section.

14. A load bearing assembly, comprising:

a plurality of elongated cord tension members arranged generally parallel to each other in a lengthwise direction, each tension member having a discontinuity, the discontinuities being staggered in the lengthwise direction such that at least some of the discontinuities are at different lengthwise positions, he plurality of tension members including laterally outermost tension members and centrally located tension members between the outermost tension members, the discontinuities in the outermost tension members having a lengthwise dimension that is at least twice a lengthwise dimension of the discontinuity in at least some of the centrally located tension members, the discontinuity in at least one centrally located tension member having a lengthwise dimension that is at least twice a lengthwise dimension of the discontinuity in at least one other centrally located tension member.

15. The load bearing assembly of claim 14, wherein the tension members each have a diameter and the lengthwise dimension of the discontinuity of each of the outermost tension members is approximately seven times the diameter.

16. The load bearing assembly of claim 15, wherein the lengthwise dimension of the discontinuity of the at least one centrally located tension member is approximately seven times the diameter.

17. The load bearing assembly of claim 14, wherein each of the tension members comprises a steel cord.

18. The load bearing assembly of claim 14, wherein each of the tension members has a circular cross-section.

* * * * *